US006348833B1

(12) United States Patent
Tsujimoto et al.

(10) Patent No.: US 6,348,833 B1
(45) Date of Patent: Feb. 19, 2002

(54) SOFT STARTING REFERENCE VOLTAGE CIRCUIT

(75) Inventors: Hirokazu Tsujimoto; Tetsuo Tateishi, both of Aichi (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/362,768

(22) Filed: Jul. 28, 1999

(30) Foreign Application Priority Data

Aug. 4, 1998 (JP) ..... 10-220761

(51) Int. Cl.[7] ..... G05F 1/575
(52) U.S. Cl. ..... 327/540; 327/539; 327/143
(58) Field of Search ..... 327/142, 143, 327/198, 538, 539, 540, 545; 323/274, 280, 281, 288, 901

(56) References Cited

U.S. PATENT DOCUMENTS 4,614,880 A * 9/1986 Go et al. ..... 327/143
5,191,278 A * 3/1993 Carpenter ..... 323/275
5,686,821 A * 11/1997 Brokaw ..... 323/273
5,912,571 A * 6/1999 Li et al. ..... 327/143
5,939,938 A * 8/1999 Kalb et al. ..... 330/51
6,034,516 * 3/2000 Goerke et al. ..... 323/901

FOREIGN PATENT DOCUMENTS

| | | |
|---|---|---|
| JP | A-56-17393 | 2/1981 |
| JP | A-58-64516 | 4/1983 |
| JP | A-62-144569 | 6/1987 |
| JP | A-7-154965 | 6/1995 |
| JP | A-9-154275 | 6/1997 |

* cited by examiner

*Primary Examiner*—Timothy P. Callahan
*Assistant Examiner*—Terry L. Englund
(74) *Attorney, Agent, or Firm*—Woodcock Washburn LLP

(57) ABSTRACT

A capacitor is connected to an output terminal. A constant current source charges the capacitor. A comparator compares the voltage of the output terminal with a threshold voltage. When the voltage of the output terminal exceeds the threshold voltage, the current supply by the constant current source to the capacitor is stopped, and the output terminal is connected to a constant voltage source through a resistor. When a predetermined time has passed after the voltage of the output terminal exceeds the threshold voltage, the output terminal is directly connected to the constant voltage source.

6 Claims, 5 Drawing Sheets

SOFT STARTING REFERENCE VOLTAGE CIRCUIT

BACKGROUND OF THE INVENTION

1. Field of the Invention

The present invention relates to a circuit for generating a reference voltage for use by other circuits, and more specifically to a circuit for generating a reference voltage for realizing a "soft start" of various circuits.

2. Description of the Related Art

There are electric circuits and electronic circuits that must be operated based on an externally applied reference voltage. For example, a DC/DC converter is normally supplied with a reference voltage which specifies an output voltage to be maintained.

A reference voltage must not be effected by temperature changes and so on. It is also necessary for a reference voltage to be increased gradually from 0 volts to a target voltage at the activation of an electric circuit or electronic circuit to which the reference voltage is applied. The process of gradually increasing a voltage from 0 to a target value under a predetermined condition can be referred to as a "soft starting" process, and a circuit for realizing the process can be referred to as a "soft start circuit".

FIG. 1A shows an example of a reference voltage circuit provided with a soft starting function. A constant voltage source 101 is, for example, a band gap reference circuit, and outputs a constant voltage Vbgr independent of a temperature. The reference voltage Vref matches the voltage Vbgr except at initial operation. A constant current source 102 supplies a current Iconst to charge a capacitor Css.

FIG. 2A shows a soft starting process performed by the reference voltage circuit shown in FIG. 1A. In FIG. 2A, it is assumed that a switch SW of FIG. 1A is OFF at initial state.

When a power supply is started at time T1, then a capacitor Css is charged by the constant current source 102 according to which a reference voltage Vref increases linearly. When the reference voltage Vref increases up to the level of the voltage Vbgr output from the constant voltage source 101 and the switch SW is turned on at time T2, the voltage Vbgr is output as the reference voltage Vref.

The above described reference voltage Vref is used, for example, as a parameter which indicates an output voltage of a DC/DC converter. In this case, the output voltage of the DC/DC converter changes in accordance with the reference voltage Vref. Therefore, if the reference voltage Vref as shown in FIG. 2A is applied to the DC/DC converter, the output voltage of the DC/DC converter gradually increases in accordance with the change in the reference voltage Vref.

In the soft starting process performed by the reference voltage circuit shown in FIG. 1A, the switch SW is turned on at time T2, as described above. Here, time T2 is the timing when the reference voltage Vref reaches the voltage Vbgr.

However, it is not easy to turn on the switch SW accurately at time T2. For example, if the switching timing is delayed and the switch SW is turned on at time T3 as shown in FIG. 2B, the reference voltage Vref temporarily exceeds the voltage Vbgr. That is to say, an overshoot occurs. On the other hand, if the switch SW is turned on before time T2 (at time T4), the reference voltage Vref temporarily drops before it reaches the voltage Vbgr as shown in FIG. 2C, or rapidly increases as shown in FIG. 2D. FIGS. 2C and 2D are examples of cases where the current supply/absorb ability of the constant voltage source 101 is low and high, respectively.

When the reference voltage Vref does not smoothly increase, the operation of the circuit using the reference voltage Vref becomes unstable. For example, in a case where the output voltage of the DC/DC converter is determined in accordance with the reference voltage Vref, the output voltage of the DC/DC converter becomes unstable if the voltages shown in FIGS. 2B through 2D are applied.

A reference voltage circuit with the soft starting process can be realized with the simple circuit shown in FIG. 1B. With this circuit, the above described problem caused by an inaccurate switching timing of the switch SW does not occur. However, with this circuit, the reference voltage Vref does not increase linearly, and a time period taken for the soft starting process cannot be accurately defined. In addition, if a resistance of the resistor R is large, the impedance of the Vref terminal becomes high, and the circuit operation is easily affected by the external noise.

SUMMARY OF THE INVENTION

The present invention intends to solve the above described problem, and aims at providing a reference voltage circuit capable of realizing a stable soft starting process.

The reference voltage circuit according to the present invention includes a constant voltage source, and a voltage generated by the constant voltage source is output as a reference voltage to be used by other circuits. The reference voltage circuit includes an output terminal, a current source, a capacitor connected to the output terminal and charged by the current source, a comparator for generating an instruction signal when the voltage at the output terminal exceeds a threshold voltage, which is lower by a predetermined value than the voltage generated by the constant voltage source, and a switch for connecting the constant voltage source to the output terminal through a resistor when the instruction signal is generated.

The output voltage from the reference voltage circuit increases in two steps up to a target voltage (voltage generated by the constant voltage source). That is to say, the output voltage from the reference voltage circuit increases according to the current source in the first step, and then increases along the RC curve depending on the resistance value of the resistor and the capacity of the capacitor in the second step. Therefore, the output voltage of the reference voltage circuit smoothly increases, without an abrupt change, until it reaches the target voltage.

DESCRIPTION OF THE PREFERRED EMBODIMENTS

The embodiment of the present invention is described below referring to the attached drawings.

Figure 1A:
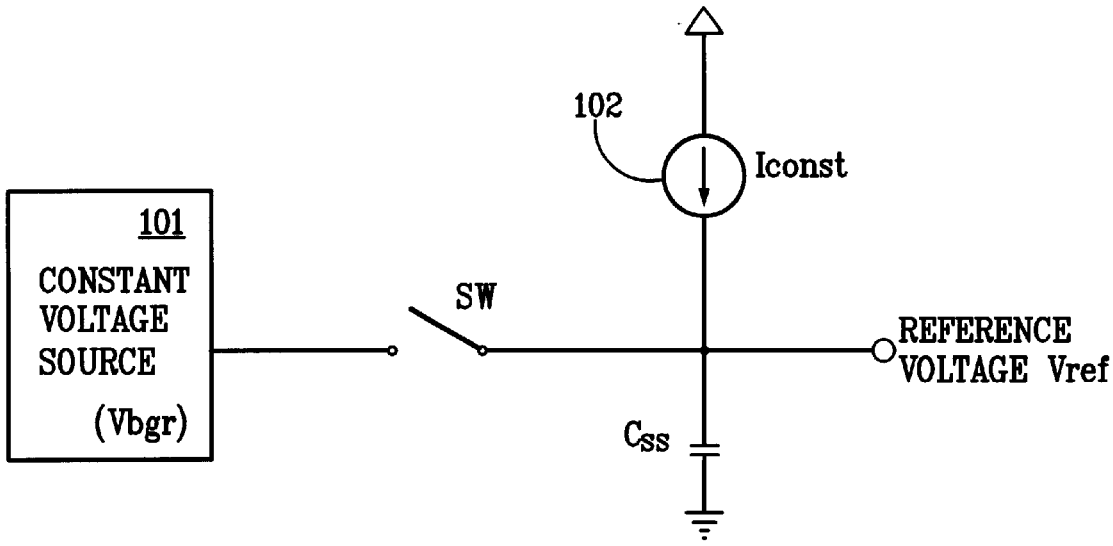
FIG. 1A Prior Art
FIGS. 1A and 1B show examples of the existing reference voltage circuit having a soft starting process.
Figure 1B:
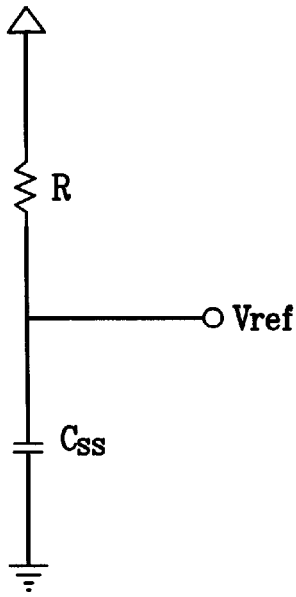
FIG. 1B Prior Art
Figure 3:
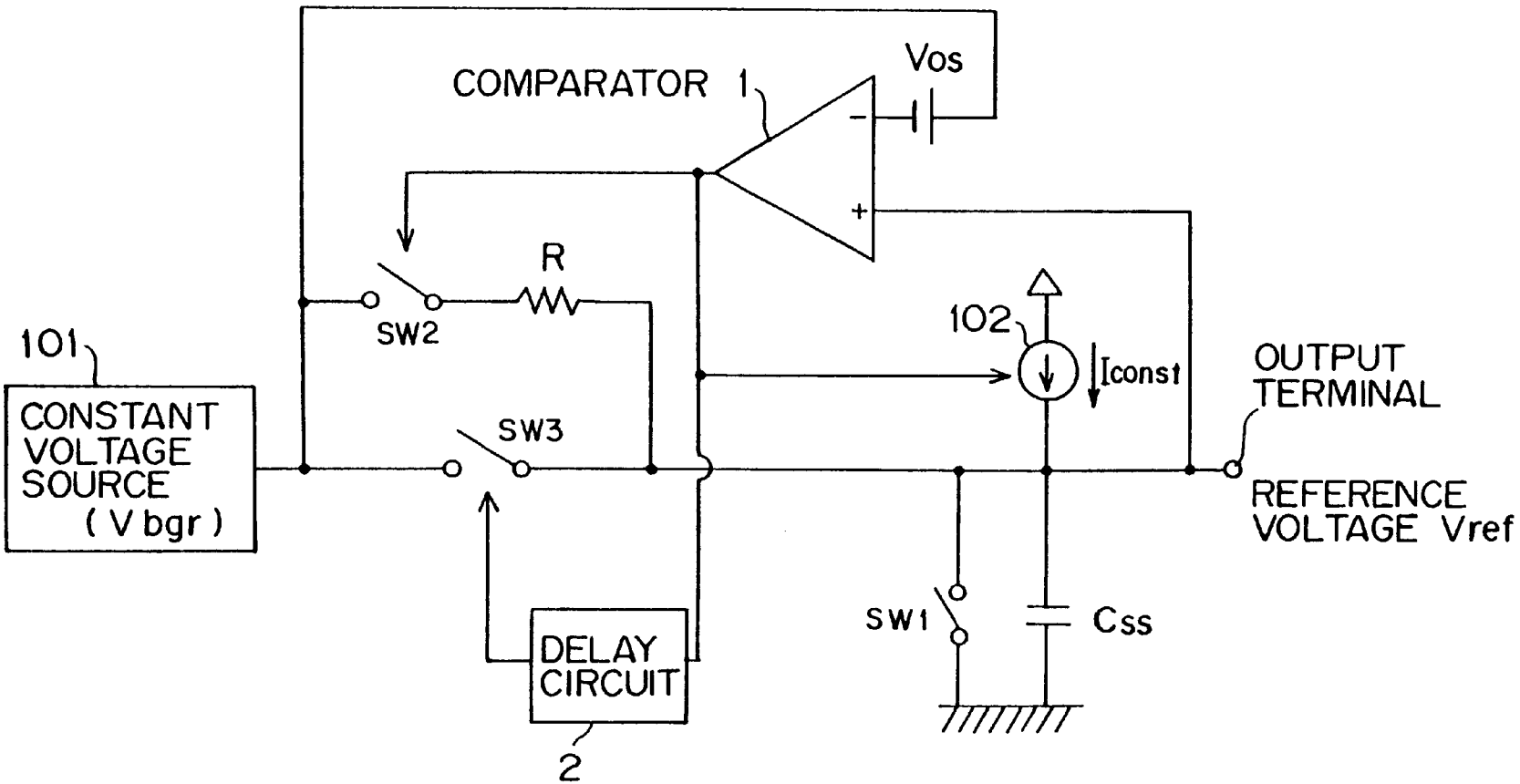
FIG. 3 shows the reference voltage circuit according to the embodiment.

FIG. 3 shows the reference voltage circuit according to an embodiment of the present invention. The constant voltage source 101, the constant current source 102, and the capacitor Css have already been described above by referring to FIG. 1A.

A comparator 1 compares the reference voltage Vref (a voltage at the output terminal of this reference voltage circuit) with the voltage Vbgr output from the constant voltage source 101. However, an offset voltage Vos is applied to the negative input terminal of the comparator 1 for receiving the output from the constant voltage source 101. Therefore, the comparator 1 actually compares the reference voltage Vref with "voltage Vbgr−voltage Vos". Hereinafter, "voltage Vbgr−voltage Vos" is referred to as a "threshold voltage Vth".

The comparator 1 outputs an instruction signal, when the reference voltage Vref exceeds the threshold voltage Vth. The instruction signal from the comparator 1 is applied to the constant current source 102, a switch SW2, and a delay circuit 2. The constant current source 102 stops outputting electric current, when the comparator 1 outputs the instruction signal. The switch SW2 is turned on (switches from an open state to a closed state) by the instruction signal. On the other hand, the delay circuit 2 delays the instruction signal output from the comparator 1, and applies it to a switch SW3. As a result, the switch SW3 is turned on at the timing when the delay time applied by the delay circuit 2 has elapsed since the reference voltage Vref exceeds the threshold voltage Vth.

Figure 4:
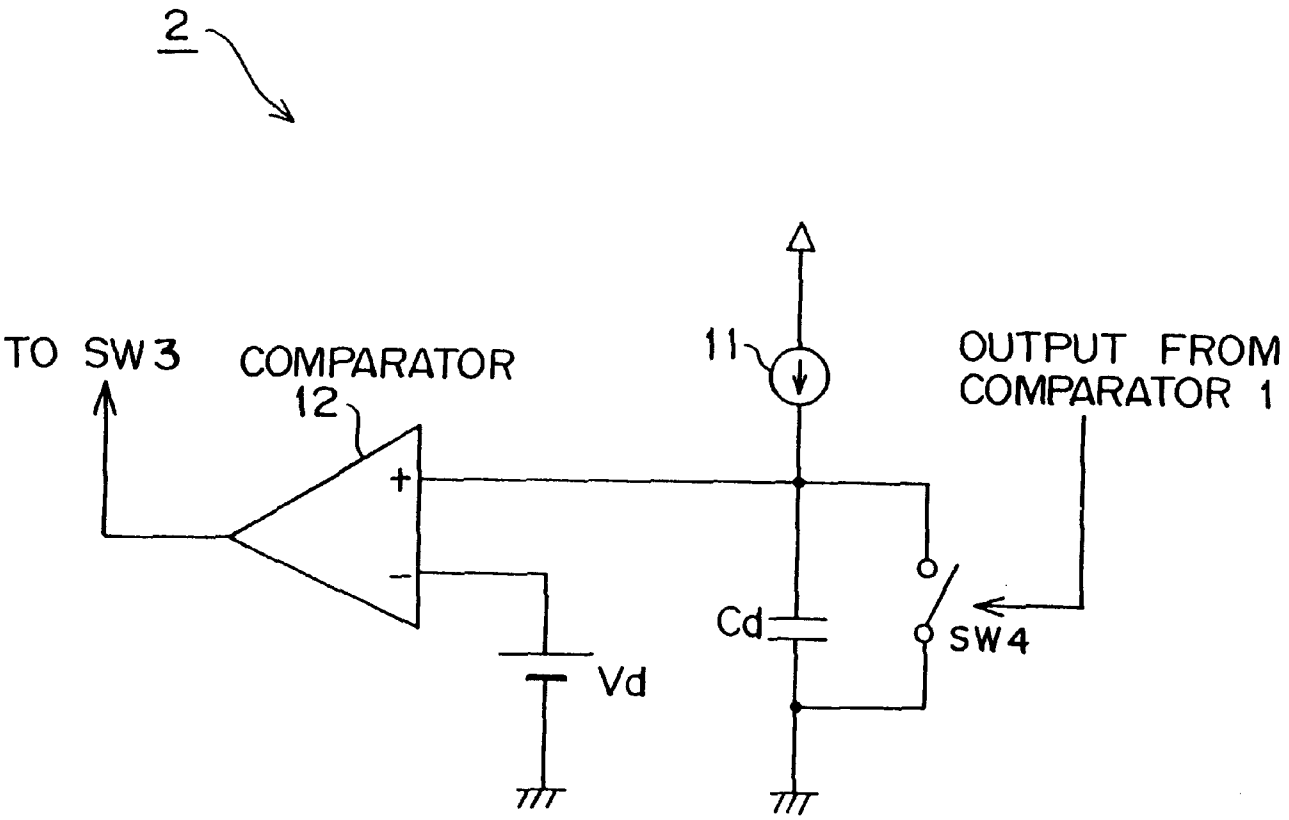
FIG. 4 shows an example of a delay circuit.

FIG. 4 shows an example of the delay circuit 2. The delay circuit 2 comprises a constant current source 11, a capacitor Cd charged by the constant current source 11, a switch SW4 for discharging the capacitor Cd, and a comparator 12 for comparing the voltage of the capacitor Cd with a predetermined voltage Vd.

The switch SW4 is ON (closed state), when the reference voltage Vref is lower than the threshold voltage Vth and the output from the comparator 1 indicates LOW. During this period, since the capacitor Cd is discharged, the output from a comparator 12 indicates LOW. When the reference voltage Vref exceeds the threshold voltage Vth and the output from the comparator 1 switches from LOW to HIGH, the switch SW4 is turned off (opened). Then, the capacitor Cd is charged by the constant current source 11, and the output from the comparator 12 is switched from LOW to HIGH, when the voltage of the capacitor Cd exceeds the voltage Vd.

Thus, the output of the delay circuit 2 is switched when a predetermined time period has passed since the output from the comparator 1 is switched. This predetermined time period can be arbitrarily set depending on the electric current generated by the constant current source 11, the capacity of the capacitor Cd, or the value of the voltage Vd.

Figure 5:
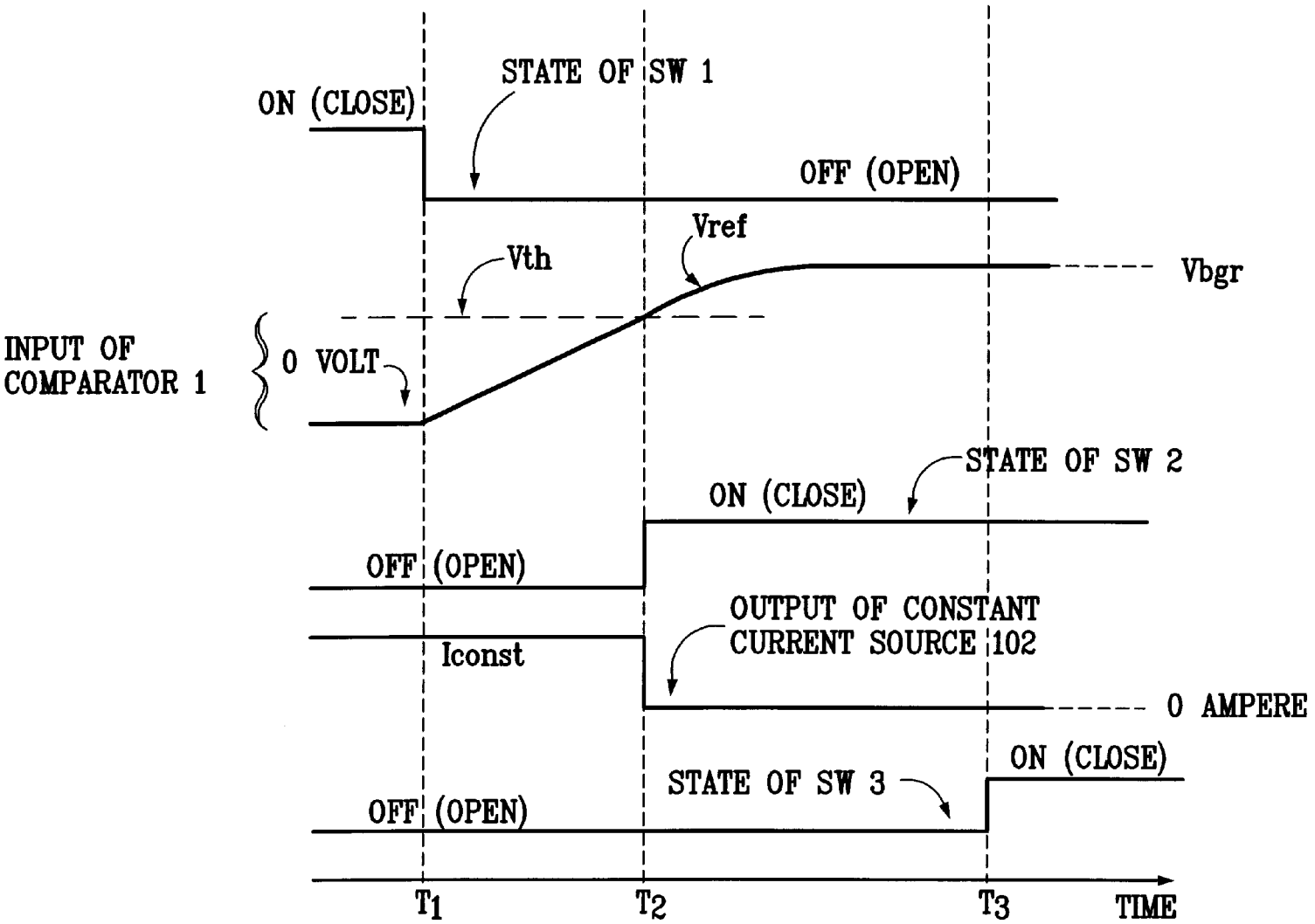
FIG. 5 shows the operations of the reference voltage circuit according to the embodiment.

The operation of this reference voltage circuit is described below referring to the timing chart shown in FIG. 5. Here, an operation performed after the switch SW1 is turned off at time T1 is explained. Before time T1, it is assumed that the switch SW1 is ON, and the switches SW2 and SW3 are OFF. In addition, since the switch SW1 is ON before time T1, the capacitor Css is discharged, and the reference voltage Vref output from this reference voltage circuit is 0 volts.

When the switch SW1 is turned of f at time T1, then the capacitor Css is charged by the constant current source 102. Therefore, the reference voltage Vref increases linearly with time. The increasing rate of the reference voltage Vref depends on the electric current Iconst generated by the constant current source 102, and the capacity of the capacitor Css.

When the reference voltage Vref increases and exceeds the threshold voltage Vth at time T2, the output of the comparator 1 is changed from LOW to HIGH. Here, the threshold voltage Vth equals "voltage Vbgr−voltage Vos", as defined above. In addition, the output of the constant voltage source 101 is assumed to be stable after time T1.

As the threshold voltage Vth, a value close to the voltage Vbgr output from the constant voltage source 101 is set. For example, a value of between approximately 90 and 95 percent of the voltage Vbgr is set as the threshold voltage Vth. The threshold voltage Vth can be changed by adjusting the offset voltage Vos.

When the output from the comparator 1 is switched from LOW to HIGH at time T2, the constant current source 102 stops charging the capacitor Css. Simultaneously, the switch SW2 is turned on. When the switch SW2 is ON, the capacitor Css is charged by the electric current from the constant voltage source 101 through the resistor R. Thus, after time T2, the reference voltage Vref increases along the RC curve according to the resistance value of the resistor R and the capacity of the capacitor Css.

If the constant current source 102 continues to generate an electric current even after the switch SW2 is turned on, then the current is absorbed (or drawn) by the constant voltage source 101. However, if the electric current generated by the constant current source 102 is relatively large and the capability of the constant voltage source 101 to absorb (or draw) electric current is small, then the reference voltage Vref can exceed a target value.

To avoid this problem and according to the present embodiment, the constant current source 102 stops supplying electric current when the switch SW2 is turned on. Thus, the reference voltage Vref does not exceed the target voltage (voltage Vbgr), even if the electric current generated by the constant current source 102 is large. Here, the large current can charge the capacitor Css within a short time. Therefore, the reference voltage Vref can increase from 0 to a level close to the voltage Vbgr within a short time.

In addition, since the constant current source 102 stops supplying electric current after the reference voltage Vref exceeds the threshold voltage Vth, the constant voltage source 101 need not absorb the current from the constant current source 102. Thus, a voltage source with a lower capability can be used as the constant voltage source 101. As a result, the constant voltage source 101 can be small in size and the required cost can be low. Furthermore, the power consumption can also be small.

The output of the comparator 1 is delayed by the delay circuit 2, and applied to the switch SW3. Therefore, the switch SW3 is turned on at time T3 after a predetermined duration has elapsed from time T2. The delay time created by the delay circuit 2 is determined such that the switch SW3 is turned on after the reference voltage Vref has substantially reached the voltage Vbgr which is the output voltage from the constant voltage source 101.

When the switch SW3 enters the ON state, the constant voltage source 101 is short-circuited to the output terminal of this reference voltage circuit. Therefore, after time T3, the voltage Vbgr generated by the constant voltage source 101 is output without modification as the reference voltage Vref.

As described above, the reference voltage Vref increases linearly from time T1 through T2. During this period, if, for example, the electric current supplied by the constant current source 102 is large, the reference voltage Vref increases from 0 to a level close to the voltage Vbgr within a short time.

Figure 2A:
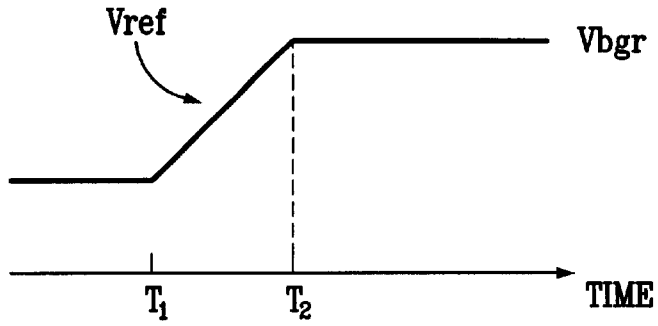
FIG. 2A Prior Art
FIGS. 2A through 2D show the soft starting processes performed by the reference voltage circuit shown in FIG. 1A.
Figure 2B:
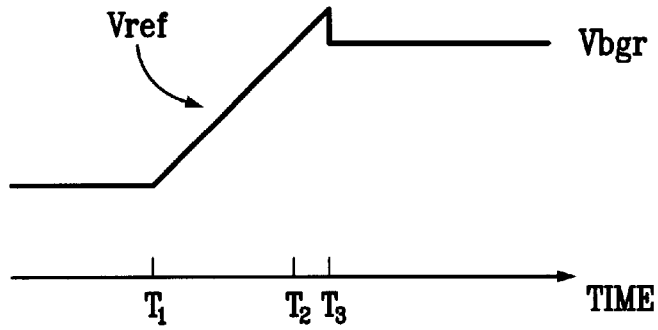
FIG. 2B Prior Art
Figure 2C:
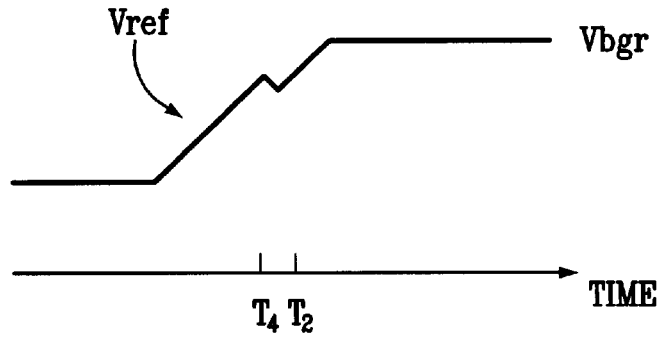
FIG. 2C Prior Art
Figure 2D:
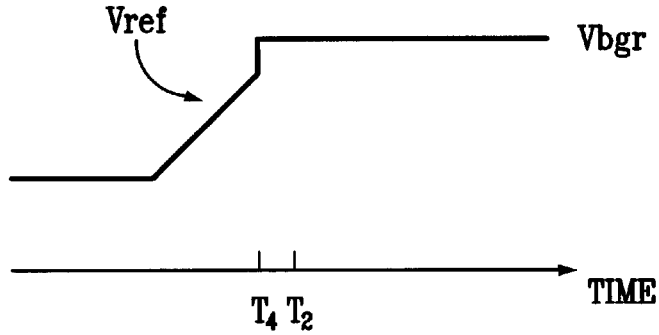
FIG. 2D Prior Art

In addition, after time T2, the reference voltage Vref increases and gradually reaches the voltage Vbgr along the RC curve depending on the resistance value of the resistor R and the capacity of the capacitor Css. Therefore, the reference voltage Vref gradually reaches the voltage Vbgr without an abrupt change as shown in FIGS. 2B through 2D. Accordingly, the operation of the circuit to which the reference voltage Vref is applied becomes stable.

Furthermore, after time T3, since the constant voltage source 101 is short-circuited to the output terminal of this reference voltage circuit, the output reference voltage Vref also becomes stable against external noise, etc. Since the reference voltage Vref is normally applied to a terminal having a high impedance, such as an input terminal of a comparator, etc., the output current of the reference voltage circuit is only of few nA. However, if the reference voltage Vref is applied to, for example, the DC/DC converter (switching voltage regulator), the switching noise may result in a relatively large current coming from the reference voltage circuit. In this case, if a path through the switch SW3 is not provided and the constant voltage source 101 and the output terminal are connected only through the resistor R, then the output voltage (that is, the reference voltage Vref) fluctuates in accordance with the voltage drop across the resistor R. According to the present embodiment, to solve this problem, the switch SW3 is turned on after the reference voltage Vref reaches the voltage Vbgr, thereby obtaining a stable output voltage.

In a case where the current supply from the constant voltage source 101 is small, if the switch SW3 is turned on before the reference voltage Vref reaches the voltage Vbgr, then the reference voltage Vref may temporarily decrease as shown in FIG. 2C. On the other hand, in a case where the current supply from the constant voltage source 101 is large, if the switch SW3 is turned on before the reference voltage Vref reaches the voltage Vbgr, then the reference voltage Vref may rapidly increase as shown in FIG. 2D. In the circuit of the present embodiment, the switch SW3 is turned on after the reference voltage Vref has reached the voltage Vbgr. Therefore, the reference voltage Vref gradually increases to the target voltage (voltage Vbgr).

After time T3, the constant current source 102 does not supply electric current, and the reference voltage Vref which is output from the reference voltage circuit is maintained by the constant voltage source 101.

Since the output voltage from the reference voltage circuit smoothly increases from 0 volts to a target voltage, a smooth soft starting operation can be realized in the circuit to which the reference voltage is applied.

What is claimed is:

1. A reference voltage circuit, provided with a constant voltage source, for outputting a voltage generated by the constant voltage source as a reference voltage to be used by other circuits, comprising:

an output terminal;

a current source;

a capacitor connected to said output terminal and charged by said current source;

a comparator which generates an instruction signal when a voltage of said output terminal exceeds a threshold voltage which is lower by a predetermined value than said voltage generated by the constant voltage source;

a first switch which connects the constant voltage source with said output terminal through a resistor when the instruction signal is generated; and a second switch which short-circuits the constant voltage source to said output terminal after the voltage of said output terminal has substantially reached said voltage generated by said constant voltage source.

2. A reference voltage circuit, provided with a constant voltage source, for outputting a voltage generated by the constant voltage source as a reference voltage to be used by other circuits, comprising:

an output terminal;

a current source;

a capacitor connected to said output terminal and charged by said current source;

a comparator which generates an instruction signal when a voltage of said output terminal exceeds a threshold voltage which is lower by a predetermined value than said voltage generated by the constant voltage source;

a first switch which connects the constant voltage source with said output terminal through a resistor when the instruction signal is generated; and a second switch which short-circuits the constant voltage source to said output terminal after the voltage of said output terminal has substantially reached said voltage generated by said constant voltage source, wherein said current source stops an electric current when the instruction signal is generated.

3. The circuit according to claim 1, wherein said constant voltage source is a band gap reference circuit.

4. A reference voltage circuit, provided with a constant voltage source, for outputting a voltage generated by the constant voltage source as a reference voltage to be used by other circuits, comprising:

an output terminal;

a current source;

a capacitor connected to said output terminal;

a comparator which compares a voltage of said output terminal with said voltage generated by the constant voltage source, and generates an instruction signal when a difference is smaller than a predetermined value;

a first switch circuit which operates such that said capacitor is charged by at least one of said current source when the voltage of said output terminal is lower than the voltage generated by said constant voltage source, and the constant voltage source through a resistor when the instruction signal is generated; and a second switch circuit which short-circuits the constant voltage source to said output terminal after the voltage of said output terminal has substantially reached said voltage generated by said constant voltage source.

5. A method of generating a reference voltage, comprising the steps of:

comparing a voltage of an output terminal with a value based on a constant voltage source;

connecting the constant voltage source with the output terminal through a circuit having a time constant when a difference between the voltage of the output terminal and the voltage of the constant voltage source is smaller than a predetermined value; and short-circuiting the constant voltage source to said output terminal after the voltage of said output terminal has substantially reached said voltage generated by said constant voltage source.

6. A method of providing a reference voltage to an output terminal, comprising the steps of:

increasing an output voltage on the output terminal linearly from 0 to a level close to the reference voltage using a constant current source and a capacitor connected to the output terminal; and increasing the output voltage from that level to the reference voltage along an RC curve using a resistor connected to a voltage source and the capacitor, the voltage source generating the reference voltage.

* * * * *